US009460868B2

(12) United States Patent
Hyrenbach et al.

(10) Patent No.: US 9,460,868 B2
(45) Date of Patent: Oct. 4, 2016

(54) ASSEMBLED POLE PART WITH POLE PART FRAME

(71) Applicant: ABB Technology AG, Zurich (CH)

(72) Inventors: Maik Hyrenbach, Ratingen (DE); Manfred Sauer, Ratingen (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/687,674

(22) Filed: Apr. 15, 2015

(65) Prior Publication Data

US 2015/0221457 A1 Aug. 6, 2015

Related U.S. Application Data

(63) Continuation of application No. PCT/EP2013/003081, filed on Oct. 14, 2013.

(30) Foreign Application Priority Data

Oct. 15, 2012 (EP) ..... 12007146

(51) Int. Cl.
*H01H 9/02* (2006.01)
*H01H 33/666* (2006.01)

(52) U.S. Cl.
CPC ..... *H01H 9/0207* (2013.01); *H01H 33/666* (2013.01); *H01H 2033/6665* (2013.01)

(58) Field of Classification Search
CPC ..... H01H 33/66; H01H 2033/6665
See application file for complete search history.

(56) References Cited

U.S. PATENT DOCUMENTS 4,429,197 A * 1/1984 Sakuma ..... H01H 33/66 218/138
5,767,451 A 6/1998 Rohling et al.
5,912,604 A * 6/1999 Harvey ..... H01H 33/6662 218/138
6,395,990 B1 5/2002 Schoentag et al.
(Continued)

FOREIGN PATENT DOCUMENTS

EP 0 763 248 B1 3/1998
SU 1601653 A1 10/1990

OTHER PUBLICATIONS

International Search Report (PCT/ISA/210) mailed on Dec. 20, 2013, by the European Patent Office as the International Searching Authority for International Application No. PCT/EP2013/003081.
Written Opinion (PCT/ISA/237) mailed on Dec. 20, 2013, by the European Patent Office as the International Searching Authority for International Application No. PCT/EP2013/003081.
Extended European Search Report issued Mar. 26, 2013, by the European Patent Office in corresponding European Patent Application No. 12007146.9-1809.
Database WPI, Section El, Week 199138, Thomson Scientific, London, GB, Class X13, AN1991-279331. XP002693983. (1 page).

*Primary Examiner* — Truc Nguyen
(74) *Attorney, Agent, or Firm* — Taft, Stettinius & Hollister LLP

(57) ABSTRACT

An exemplary assembled pole part includes two pole part frames made of insulating material, between which a vacuum interrupter is mounted. The vacuum interrupter includes a fixed contact and a moving contact. The frame includes a first support to affix the vacuum interrupter at the moving contact side, and a second support to affix the vacuum interrupter to the fixed contact side at an opposite end of the frame. In order to apply common pole part frames for different vacuum interrupter sizes, in order to alleviate the manufacture of such pole parts, at least two fixation points are arranged pairwise in parallel along different distances along the long axis of the frame. The first support at the moving contact side maintains a specified fixation position, so the frame is configured for use with at least one other vacuum interrupter of a different length.

17 Claims, 1 Drawing Sheet

(56) References Cited

U.S. PATENT DOCUMENTS 8,115,123 B2 * 2/2012 Singh ..... H01H 9/0072 200/50.21
2001/0025830 A1 10/2001 Allard et al.
2005/0092713 A1 * 5/2005 Chyla ..... H01H 1/5833 218/118

* cited by examiner

ASSEMBLED POLE PART WITH POLE PART FRAME

RELATED APPLICATION(S)

This application claims priority under 35 U.S.C. §120 to International application PCT/EP2013/003081 filed on Oct. 14, 2013, designating the U.S., and claiming priority to European application 12007146.9 filed on Oct. 15, 2012. The content of each prior application is hereby incorporated by reference in its entirety.

FIELD

The present disclosure relates to an assembled pole part with two pole part frames made of insulating material, between which a vacuum interrupter is mounted.

BACKGROUND INFORMATION

A known assembled pole part is disclosed in published document EP 0 763 248 B1. The insulating frame parts are made of plastic. The vacuum interrupter is fixed via fastening elements which are implemented in the frame parts at definite fixation points.

By this construction the frame parts are applied to establish a definite (e.g., specified) vacuum interrupter size.

After the fixation of the vacuum interrupter on the first frame part, the second frame part is fixed to form the other side, so that the vacuum interrupter is fixed between both frame parts.

The assembled pole parts are used in switching devices, such as in gas filled switching devices.

A disadvantage for this known construction includes the frame parts being applied only to one vacuum-interrupter size.

SUMMARY

An exemplary assembled pole part is disclosed, comprising: two pole part frames made of insulating material, between which a vacuum-interrupter is mounted, wherein the vacuum interrupter includes with a fixed contact and a moving contact, a first support at a moving contact end to affix the vacuum interrupter to the pole part frames, and a second support at a fixed contact end to affix the vacuum interrupter to the pole part frames, wherein groups of at least two parallel fixation means or fixation points are arranged at different distances along a longitudinal axis of each pole part frame, wherein the first support at the moving contact side maintains a specified fixation position and a position of the second support is selectable via the groups of fixation points, and wherein via the groups of at least two parallel fixation points the two pole part frames are configured to accommodate vacuum interrupters of different lengths.

An exemplary assembled pole part is disclosed, comprising: two pole part frames made of insulating material, between which a vacuum-interrupter is mounted, wherein the vacuum interrupter is applied with a fixed contact and a moving contact, a first support at a moving contact end to affix the vacuum interrupter to the pole part frames, and a second support at a fixed contact end to affix the vacuum interrupter to the pole part frames, wherein each pole part frame includes plural pairs of fixation points that are arranged in parallel and at a specified distance from each other along a longitudinal axis, and wherein the first support is affixed at the moving contact side maintains a specified fixation position and, via the plural pairs of fixation points, a distance between the second support and the first support is selectable so that the pole part frames are configured to accommodate vacuum interrupters of different lengths.

An exemplary assembled pole part is disclosed, comprising: two pole part frames made of insulating material; a vacuum-interrupter is mounted between the pole part frames, the vacuum interrupter having a fixed contact and a moving contact, a first support at a moving contact end to affix the vacuum interrupter to the pole part frames, and a second support a fixed contact end to affix the vacuum interrupter to the pole part frames, each pole part frame having groups of at least two parallel fixation means or fixation points are arranged at different distances along a longitudinal axis, wherein the second support is affixed to the pole part frames via one of the groups of parallel fixation points, and wherein via the groups of at least two parallel fixation points the two pole part frames are configured to accommodate vacuum interrupters of different lengths.

BRIEF DESCRIPTION OF THE DRAWINGS

The foregoing and other aspects of the disclosure will become apparent following the detailed description of the disclosure, when considered in conjunction with the enclosed drawings in which.

DETAILED DESCRIPTION

Figure 1B:
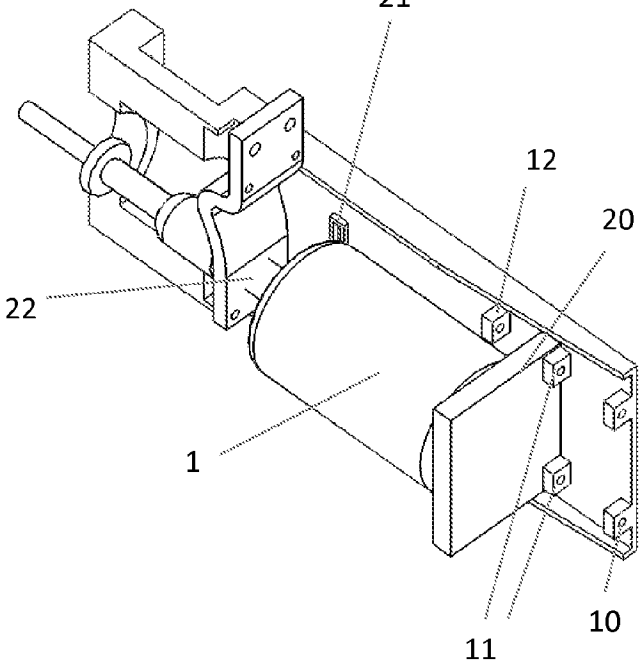
FIGS. 1*a* and 1*b* illustrate assembly states of a pole part in accordance with an exemplary embodiment of the present disclosure.

Exemplary embodiments of the present disclosure apply common pole part frames for different vacuum interrupter sizes, in order to alleviate the manufacture of such pole parts. The vacuum interrupter is applied with a fixed contact and a moving contact, so that at one end of the frame is applied with a first support in order to fix the vacuum interrupter at the moving contact side, and fixation means for the fixed contact side at the other end of the frame, according to preamble of claim 1

According to an exemplary embodiment of the present disclosure, at least two fixation means or fixation points are arranged pairwise in parallel along different distances to each along the long axis of the frame, wherein the second support is the fixation means for the fixed contact side of the vacuum interrupter, in order be able to use one uniform constructed frame design for different vacuum interrupter lengths, in that way, and independent of the used vacuum interrupter length, the moving contact fixation support maintains the same fixation position.

According to another exemplary embodiment, a pair of fixation points are arranged pairwise in parallel at one defined distance at the long axis of the frame, in order to be connected with the second support in that way, the support can be provided with a distance adapter having a selectable thickness so that one uniform constructed frame design can be used for different vacuum interrupter lengths, and independent of the used vacuum interrupter length, the moving contact fixation support is maintained at the same fixation (e.g., fixed) position.

According to another exemplary embodiment of the present disclosure, the different length measures are considered (e.g., different lengths of vacuum interrupters are accommodated between the supports) by having several pairs of fixations points.

According to yet another exemplary embodiment, the each length measures of a vacuum interrupter uses one pair of fixations points, and a support that can be positioned at with different distances from the other support. Both result in the use of a uniformed construction for different possible lengths of vacuum interrupters.

The exemplary embodiments disclosed herein provide advantages in that at each fixation point a pair of fixation means are arranged in parallel at the same distance (e.g., point along the longitudinal axis). As a result, the arrangement of two parallel frame parts results in four fixation points at each distance (e.g., point) in order to affix a plate thereto. The dimensions of the support plate are determined by the diameter of the vacuum interrupter.

To accommodate vacuum interrupters of different lengths at least two groups of fixation points are implemented at respective distances (e.g., points) along the longitudinal axis.

Furthermore, the fixation points on both frame parts are arranged at each fixation distance such that in a mounted condition four fixation points are used at each specified distance associated with a length of a vacuum interrupter.

An advantageous result of this arrangement, provides that at each fixation point or distance a plate can be fixed to the fixation means at each defined distance.

According to yet another exemplary embodiment, the fixation means are integrally formed in the frame parts. As a result, vacuum interrupters of different sizes can be manufactured from a common construction type (e.g., frame).

Exemplary embodiments described herein include guiding means (e.g., guide, projection, protrusion) for the movable contact stem of the vacuum interrupter that can be provided between the two frame parts as well.

The frame parts can be made of insulating material, so that the vacuum interrupter of the completed assembled pole part is sandwiched between the insulating frame parts.

Figure 1A:
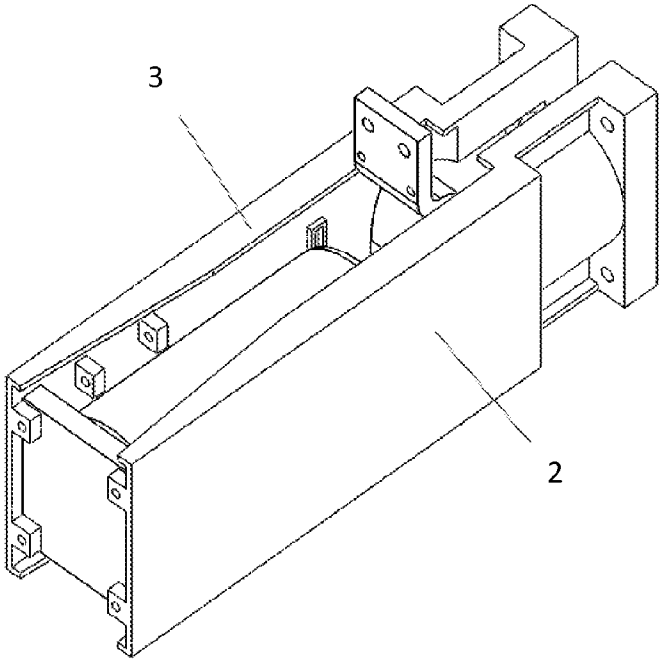

FIGS. 1*a* and 1*b* illustrate assembly states of a pole part in accordance with an exemplary embodiment of the present disclosure. As shown in FIGS. 1*a* and 1*b*, the pole part includes a vacuum interrupter 1 that is arranged to be fixed between two frame parts 2 and 3. In FIG. 1*a*, the pole part partially assembled, or not completed, and shows the positioned vacuum interrupter 1. The fixed contact side of the vacuum interrupter is mounted on a metal plate 20, which is fixed at the fixation points 11. The fixations points 11 are integrated in the frame parts.

The vacuum interrupter 1 can be of a length such that the plate 20 is mounted, according to an exemplary embodiment, in the middle position of the possible 3 positions.

Further fixation points 10 are provided for longer vacuum interrupters and further fixation points 12 for shorter vacuum interrupters are also provided. So this exemplary uniform frame design can be used for three different vacuum interrupter length dimensions.

Further guiding means 21 for the movable contact stem 22 of the vacuum interrupter 1 is also implemented in the frame parts 2 and 3.

FIG. 1*b* shows the fully assembled pole part with two complementary designed frame parts 2 and 3, with a ready positioned vacuum interrupter between them. In result, the plate 20 is fixed in each frame part at the adjacent positions fixation points.

Such assembled pole parts are designed for medium voltage circuit breakers. The pole parts are screwed to a base plate, not further shown, for all three pole-parts at the one side and a smaller metal-plate between the isolation-parts at the other (e.g., opposite) side. The metal plate 20, as shown in FIGS. 1*a* and 1*b*, is screwed to the insulating frame parts 2 and 3, and the position of the metal plate 20 is applied (e.g., related) to the length of the inserted vacuum interrupter 1.

At the other side of the vacuum interrupter, its movable contact is connected to a current-lamination and further to an operating stud, which is not shown in FIG. 1.

Because the frame of the pole part is made by two parallel insulating frame parts 2 and 3, the position of the metal plate 20 can be selected, according to the length of the used vacuum interrupter 1.

According to another exemplary embodiment of the present disclosure, for each frame part only one pair of fixation points, where each pair of fixation points establishes a different distance between support plates, is specified for each possible length of vacuum interrupters. Exemplary embodiments described herein are advantageous in that one uniform construction of frame parts 2 and 3 can be used for different vacuum interrupter lengths. Additionally, the frame parts 2 and 3 are identical, so that manufacturing costs can be reduced.

Further, advantages realized through the exemplary embodiments, include the distance between the parallel insulating frames being varied with the diameter of the specified vacuum interrupter. In an exemplary embodiment in which a smaller diameter is specified, the width of the created pole is smaller, too. This provides increased flexibility and provides a capacity to vary the poles in the context of the associated vacuum interrupter and the specified pole distance.

As a result, exemplary embodiments of the present disclosure, provide for the same basic construction and dimensions of the frame parts for use with different vacuum interrupter lengths and diameters.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

POSITION NUMBERS

1 Vacuum interrupter
2 Frame part
3 Frame part
10 further fixation points
11 fixation points
12 further fixation points
20 metal plate
21 further guiding means
22 movable contact stem

What is claimed is:

1. An assembled pole part, comprising:

two pole part frames made of insulating material, between which a vacuum-interrupter is mounted, wherein the vacuum interrupter includes with a fixed contact and a moving contact, a first support at a moving contact side to affix the vacuum interrupter to the pole part frames, and a second support at a fixed contact side to affix the vacuum interrupter to the pole part frames, wherein groups of at least two parallel fixation means or fixation points are arranged on each pole part frame and at different distances along a longitudinal axis of each pole part frame, wherein the first support at the moving contact side maintains a specified fixation position and a position of the second support is selectable via the groups of fixation points, and wherein via the groups of at least two parallel fixation points the two pole part frames are configured to accommodate vacuum interrupters of different lengths.

2. The assembled pole part according to claim 1, wherein for each pole part frame the groups of fixation points are arranged in parallel at a same distance from the first support.

3. The assembled pole part according to claim 1, wherein the groups of at least two fixation points are disposed at different distances from the first support.

4. The assembled pole part according to claim 1, wherein the fixation points are integrally formed in the frame parts.

5. The assembled pole part according to claim 1, wherein guiding means for the movable contact stem of the vacuum interrupter are provided between the two pole part frames.

6. The assembled pole part according to claim 1, wherein the pole part frames are made of insulating material.

7. The assembled pole part according to claim 1, wherein the pole part frames are positioned in parallel and spaced apart at a distance determined by a diameter of the vacuum interrupter.

8. The assembled pole part according to claim 1, wherein the groups of fixation points on both frame parts are arranged such that two fixation points of each frame part are aligned such that in a mounted condition of the pole part, four fixation point are arranged at a same distance from the first support.

9. The assembled pole part according to claim 8, wherein at each group of fixation points the first support a plate can be spaced from the second support at a specified distance.

10. An assembled pole part, comprising:

two pole part frames made of insulating material, between which a vacuum-interrupter is mounted, wherein the vacuum interrupter is applied with a fixed contact and a moving contact, a first support at a moving contact side to affix the vacuum interrupter to the pole part frames, and a second support at a fixed contact side to affix the vacuum interrupter to the pole part frames, wherein each pole part frame includes plural pairs of fixation points that are arranged in parallel and at a specified distance from each other along a longitudinal axis, and wherein the first support is affixed at the moving contact side maintains a specified fixation position and, via the plural pairs of fixation points, a distance between the second support and the first support is selectable so that the pole part frames are configured to accommodate vacuum interrupters of different lengths.

11. The assembled pole part according to claim 10, wherein the fixation points are integrally formed in the frame parts.

12. The assembled pole part according to claim 10, wherein guiding means for the movable contact stem of the vacuum interrupter are provided between the two pole part frames.

13. The assembled pole part according to claim 10, wherein the pole part frames are made of insulating material.

14. The assembled pole part according to claim 10, wherein the pole part frames are positioned in parallel and spaced apart at a distance determined by a diameter of the vacuum interrupter.

15. The assembled pole part according to claim 10, wherein the groups of fixation points on both frame parts are arranged such that two fixation points of each frame part are aligned such that in a mounted condition of the pole part, four fixation point are arranged at a same distance from the first support.

16. The assembled pole part according to claim 15, wherein at each group of fixation points the first support a plate can be spaced from the second support at a specified distance.

17. An assembled pole part, comprising:

two pole part frames made of insulating material;

a vacuum-interrupter is mounted between the pole part frames, the vacuum interrupter having a fixed contact and a moving contact, a first support at a moving contact side to affix the vacuum interrupter to the pole part frames, and a second support a fixed contact side to affix the vacuum interrupter to the pole part frames, each pole part frame having groups of at least two parallel fixation means or fixation points are arranged at different distances along a longitudinal axis, wherein the second support is affixed to the pole part frames via one of the groups of parallel fixation points, and wherein via the groups of at least two parallel fixation points the two pole part frames are configured to accommodate vacuum interrupters of different lengths.

* * * * *